US007040417B2

(12) United States Patent
Campbell et al.

(10) Patent No.: US 7,040,417 B2
(45) Date of Patent: May 9, 2006

(54) DRILLING SYSTEMS

(75) Inventors: Paul B. Campbell, Troutville, VA (US); James E. Coffman, Tulsa, OK (US)

(73) Assignee: CCT Technologies, L.L.C., Tulsa, OK (US)

( * ) Notice: Subject to any disclaimer, the term of this patent is extended or adjusted under 35 U.S.C. 154(b) by 297 days.

(21) Appl. No.: 10/733,171

(22) Filed: Dec. 11, 2003

(65) Prior Publication Data

US 2005/0126822 A1 Jun. 16, 2005

(51) Int. Cl.
*E21B 4/14* (2006.01)

(52) U.S. Cl. ..... 175/57; 173/138; 173/1; 175/93; 175/135; 175/296

(58) Field of Classification Search ..... 175/57, 175/296, 92, 93, 135; 173/138, 1, 95; 405/232
See application file for complete search history.

(56) References Cited

U.S. PATENT DOCUMENTS

| | | | | |
|---|---|---|---|---|
| 1,005,770 | A * | 10/1911 | Clark | 173/78 |
| 1,656,540 | A * | 1/1928 | Smith | 173/67 |
| 1,866,335 | A * | 7/1932 | Paul | 173/197 |
| 2,041,690 | A * | 5/1936 | Baumeister et al. | 175/135 |
| 2,389,711 | A | 11/1945 | Armentrout | |
| 2,868,511 | A * | 1/1959 | Barrett | 175/92 |
| 3,193,024 | A | 7/1965 | Cleary | 173/17 |
| 3,266,581 | A * | 8/1966 | Cooley et al. | 173/162.1 |
| 3,568,783 | A | 3/1971 | Chenoweth et al. | 175/92 |
| 4,500,267 | A | 2/1985 | Birdwell | 417/552 |
| 4,541,779 | A | 9/1985 | Birdwell | 417/62 |
| 4,631,970 | A | 12/1986 | Pauls | 74/44 |
| 4,650,584 | A | 3/1987 | Maciorewicz | 210/512.2 |
| 4,676,724 | A | 6/1987 | Birdwell | 417/342 |
| 4,694,911 | A | 9/1987 | Kennedy | 173/62 |
| 4,699,223 | A | 10/1987 | Noren | 175/40 |
| 4,705,118 | A | 11/1987 | Ennis | 175/65 |
| 4,771,835 | A | 9/1988 | Eaton | 175/92 |

(Continued)

FOREIGN PATENT DOCUMENTS

EP 0088705 9/1983

(Continued)

OTHER PUBLICATIONS

PCT/GB2004/050038, PCT Int'l Search Report, PCT counterpart of 10/733,171, Feb. 4, 2005; 8 pp.

*Primary Examiner*—Hoang Dang
(74) *Attorney, Agent, or Firm*—Head, Johnson & Kachigian

(57) ABSTRACT

The present invention discloses, in certain aspects, systems and methods for producing cyclical impacts and, in certain aspects for moving a drilling apparatus for drilling a borehole in a formation, the system in certain embodiments including a housing with a longitudinal axis and a movable member movably disposed therein and movable within the housing transversely to the longitudinal axis of the housing and positioned within the housing with a first space on a first side thereof and a second space on a second side thereof, the movable member substantially fluidly isolating the two spaces and movable to compress gas in one of the first space and the second space while decompressing gas in the other space so that a charge of compressed gas exits from the housing to move an impact member; e.g. for impacting a pile to be driven into the earth or for impacting a drill apparatus for drilling a wellbore, the movable member movable continuously to provide a series of impacts.

24 Claims, 7 Drawing Sheets

U.S. PATENT DOCUMENTS

| | | | | |
|---|---|---|---|---|
| 4,790,390 | A | 12/1988 | Sweeny | 173/17 |
| 4,819,746 | A | 4/1989 | Brown et al. | 175/296 |
| 4,921,056 | A | 5/1990 | Ennis | 175/92 |
| 5,207,283 | A | 5/1993 | Lay | 175/296 |
| 5,222,425 | A | 6/1993 | Davies | 91/273 |
| 5,350,023 | A | 9/1994 | Klemm | 173/17 |
| 5,396,965 | A | 3/1995 | Hall et al. | 173/73 |
| 5,411,107 | A | 5/1995 | Hailey et al. | 175/296 |
| 5,419,403 | A | 5/1995 | Klemm | 173/115 |
| 5,497,839 | A | 3/1996 | Moir | 175/65 |
| 5,634,524 | A * | 6/1997 | Campbell | 175/296 |
| 5,662,180 | A | 9/1997 | Coffman et al. | 175/57 |
| 5,715,897 | A | 2/1998 | Gustafson | 175/296 |
| 5,803,188 | A | 9/1998 | McInnes | 175/92 |
| RE36,166 | E | 3/1999 | Johns et al. | 175/61 |
| 5,957,220 | A | 9/1999 | Coffman et al. | 175/91 |
| 6,047,778 | A | 4/2000 | Coffman et al. | 175/91 |
| 6,155,361 | A | 12/2000 | Patterson | 175/296 |
| 6,386,301 | B1 | 5/2002 | Rear | 175/296 |
| 6,557,652 | B1 * | 5/2003 | Klemm | 175/296 |
| 6,659,202 | B1 | 12/2003 | Runquist et al. | 175/61 |
| 2003/0056990 | A1 | 3/2003 | Oglesby | 175/57 |
| 2003/0111240 | A1 | 6/2003 | Karasawa et al. | |

FOREIGN PATENT DOCUMENTS

| | | |
|---|---|---|
| GB | 962127 | 6/1964 |
| SU | 810952 | 3/1981 |

* cited by examiner

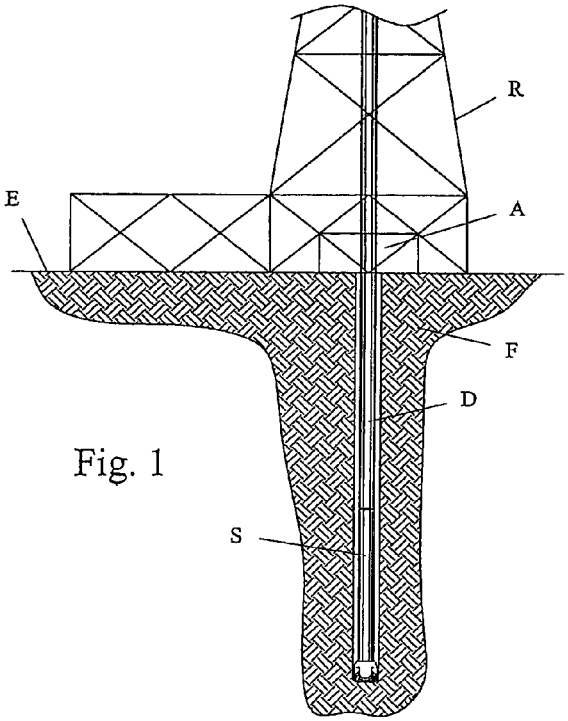
Fig. 1
Fig. 3
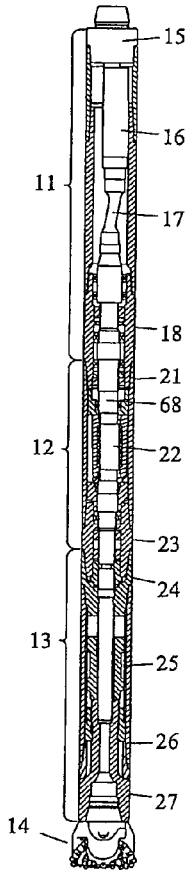
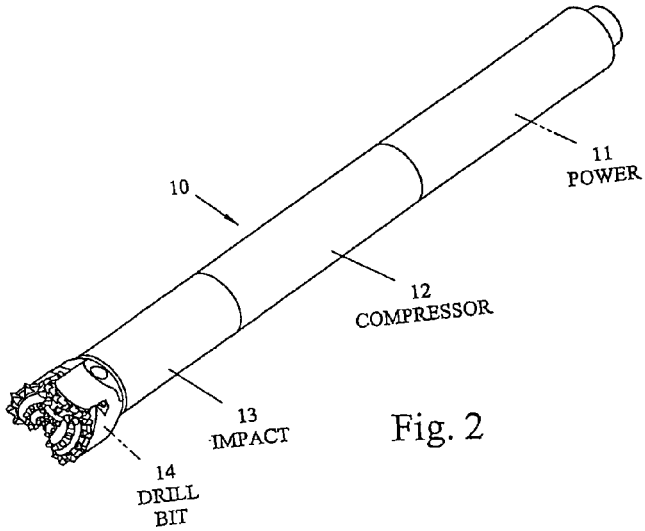
Fig. 2

DRILLING SYSTEMS

BACKGROUND OF THE INVENTION

1. Field of the Invention

The present invention is directed to wellbore drilling systems and, in certain aspects, to such systems with a percussion drill assembly which cyclically impacts a drill bit.

2. Description of Related Art

The rate of penetration of a formation by a drill bit is generally proportional to the weight, or downward thrust, placed on the drill bit. The addition of repetitive impact blows on a drill bit, e.g. those provided by a percussion drilling assembly, regardless of the weight applied to the bit, will increase the penetration rate of the drill bit. Due to the short duration of each impact blow, deviation of the borehole is minimized. Impact blows, therefore, can be used as a substitute for part of the weight on the drill bit.

One typical percussion drill assembly for drilling a borehole in an earth formation is described in U.S. Pat. No. 5,662,180 issued Sep. 2, 1997 incorporated fully herein by reference. The assembly disclosed in U.S. Pat. No. 5,662,180 has a compressor system with endless loop grooves formed in the outer surface of a rotary shaft whose rotation results in the cyclic compression of gas to provide cyclic impacts on a drill bit. This structure required special manufacturing techniques and equipment not available in all machine shops. High inertial loading on the contact surfaces of the endless loop grooves caused high wear, requiring frequent replacement of the complete rotary shaft section. Roller elements that extended into the endless loop grooves required specialized profile grinding and heat treatment processes, and were also subjected to the same high inertial loading that created the need for frequent replacement. The constraints of the compressor geometry in certain embodiments required some gas flow passages and gas volummes to be integral to the compressor piston, and the resulting complexity caused difficulty in achieving optimum performance. The length of the compressor assembly in certain embodiments made it difficult to stay within the required overall length constraints of the system.

There has long been a need, recognized by the present inventors, for an easily manufactured percussion drill assembly with relatively long-lived components and for relatively simple compressor systems for such assemblies. There has long been a need for such assemblies and compressor systems which are relatively more compact and which require relatively longer service intervals. There has long been a need, recognized by the present inventors, for a system which extends bit life in certain formations.

SUMMARY OF THE PRESENT INVENTION

The present invention, in certain aspects, teaches a system for moving a drilling apparatus for drilling a wellbore in an earth formation, the system including: a housing with a longitudinal axis; a movable member movably disposed within the housing, the movable member movable within the housing transversely to the longitudinal axis of the housing, the movable member positioned within the housing with a first space on a first side thereof and a second space on a second side thereof, the first space substantially fluidly isolated from the second space by the movable member, the movable member movable to compress gas in one of the spaces [first space or the second space] while decompressing gas in the other of the spaces so that a charge of compressed gas exits from the housing to move an impact member for impacting the drill apparatus for drilling the wellbore, the movable member movable continuously to provide a series of a plurality of movements of the impact member.

The present invention, in at least certain aspects, discloses a drilling system with a percussion drill assembly for drilling a borehole in a formation, the percussion drill assembly including: an elongated housing assembly having a first end adapted to removably connect the drill assembly to a drill string, and a second end adapted to receive a drill bit: a first compartment formed within said housing assembly and having a longitudinal axis; a hammer piston positioned within said first compartment for reciprocal motion within said first compartment along the longitudinal axis of said first compartment, the hammer piston dividing the first compartment into a first chamber and a second chamber which are substantially fluidly isolated from each other within the first compartment by the presence of said hammer piston; a fluid compressor positioned within the housing assembly and having a first port in the first chamber and a second port in the second chamber; wherein a second compartment is formed within the housing assembly, the second compartment having a longitudinal axis; wherein the fluid compressor has a compressor piston positioned within the second compartment for reciprocal motion within the second compartment perpendicular to the longitudinal axis of the second compartment, the compressor piston dividing the second compartment into a third chamber and a fourth chamber which are substantially fluidly isolated from each other within the second compartment by the presence of the compressor piston; wherein the first port provides fluid communication with the third chamber, and the second port provides fluid communication with the fourth chamber; a driver mounted in the housing assembly and connected to the compressor piston so as to drive the compressor piston to produce a high fluid pressure in the first port and a low fluid pressure in the second port during a first half cycle of operation of the fluid compressor and to produce a low fluid pressure in the first port and a high fluid pressure in the second port during a second half cycle of operation of the fluid compressor; and wherein the driver is connected to the compressor piston to cause reciprocating movements of the compressor piston within the second compartment.

Such a drilling system and such a percussion drilling assembly may have, according to certain aspects of the present invention, a driver which is a fluid motor driven by a drilling fluid passed downwardly through a drill string to the drill assembly, and wherein the drilling fluid is exhausted from the fluid motor through the second end of the housing assembly and through the drill bit. Such a drilling system and such a percussion drilling assembly may operate so that when the driver is a fluid motor it has a liquid inlet and a liquid outlet, a stator, and a rotor positioned between the liquid inlet and the liquid outlet, the driver with a rotary shaft and the rotor connected to the rotary shaft so that rotation of the rotor causes corresponding rotation of the rotary shaft to drive the fluid compressor. Such a percussion drilling assembly may also have the liquid inlet of the motor connected to an inlet passageway in the first end of the housing assembly so that liquid from a drill string flows through the inlet passageway and then flows between the stator and the rotor to the liquid outlet to effect rotation of the rotor with respect to the housing assembly, thereby rotating the rotary shaft and driving the fluid compressor. In certain aspects of the present invention, any suitable known fluid motor or "mud motor" may be used; including, but not limited to the motors disclosed or referred to in U.S. Pat. Nos. 5,833,44; 5,785, 509; 5,518,379; 5,171,139; 5,195,882; 5,350,242; 5,460,496 [all of said patents incorporated fully herein for all purposes] and in the references cited in these patents.

The present invention discloses an apparatus with a movable member within a housing, the housing having a longitudinal axis, the movable member movable within the housing transversely or perpendicular to the longitudinal axis of the housing so that such movement compresses gas in one space adjacent the movable member while decompressing it in another space adjacent the movable member to provide a charge of compressed gas which exits from the housing. This charge of compressed gas may be used to effect hammering movement of a hammer piston or for providing cyclical movement in a wellbore tool, system, or drilling apparatus.

In certain formations, e.g. abrasive formations that fracture easily, systems according to the present invention invention extend bit life since the formation is fractured rather than ground by the bit.

In certain formations (including, but not limited to, loose or sandy material at the ocean floor) systems according to the present invention provide impacts without rotation, e.g. for driving pipe, casing, or piles into the earth or into the ocean floor.

It is, therefore, an object of at least certain preferred embodiments of the present invention to provide:

New, useful, unique, efficient, non-obvious wellbore drilling systems, percussion drilling assemblies for such systems, and methods of use of such systems and assemblies;

Compressors for such a percussion drilling system that can be manufactured using conventional machining and grinding equipment;

Compressors for such a percussion drilling system that use easily replaced commercial quality bearings;

Compressors for such a percussion drilling system with reduced inertial loading on bearing and shaft components;

Compressors for such a percussion drilling system with clearly defined and simple flow passages and clearance volumes;

Compressors for such a percussion drilling system that have a relatively longer component life;

Compressors for such a percussion drilling system that have a relatively compact and simpler assembly as compared to certain prior art systems;

Such systems and assemblies with an apparatus that includes compressor apparatus with a movable part within a housing, the housing having a longitudinal axis, the movable part movable in a direction transverse to or perpendicular to the longitudinal axis to compress fluid for moving an impacting member in the direction of the longitudinal axis to impact a drill bit; and Methods of using such systems, such assemblies, and such apparatus.

It is, therefore, an object of at least certain preferred embodiments of the present invention to provide new, useful, unique, efficient, non-obvious impact systems having an internal member that moves side-to-side or transversely to a longitudinal axis of a housing in which it is located to provide impact(s) aligned with the longitudinal axis; and, in certain aspects, such impact systems for use in drilling boreholes in the earth or for driving piles, etc., into the earth or into the ocean floor.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

BRIEF DESCRIPTION OF THE DRAWINGS

A more particular description of certain embodiments of the invention may be had by references to the embodiments which are shown in the drawings which form a part of this specification.

FIG. 1 is a cross-sectional schematic view of a drilling system according to the present invention.

FIG. 2 is a perspective view of the percussion drill assembly of the system of FIG. 1.

FIG. 3 is a cross-sectional view of an embodiment of the percussion drill assembly of FIG. 2.

DESCRIPTION OF EMBODIMENTS PREFERRED AT THE TIME OF FILING FOR THIS PATENT

Figure 4A:
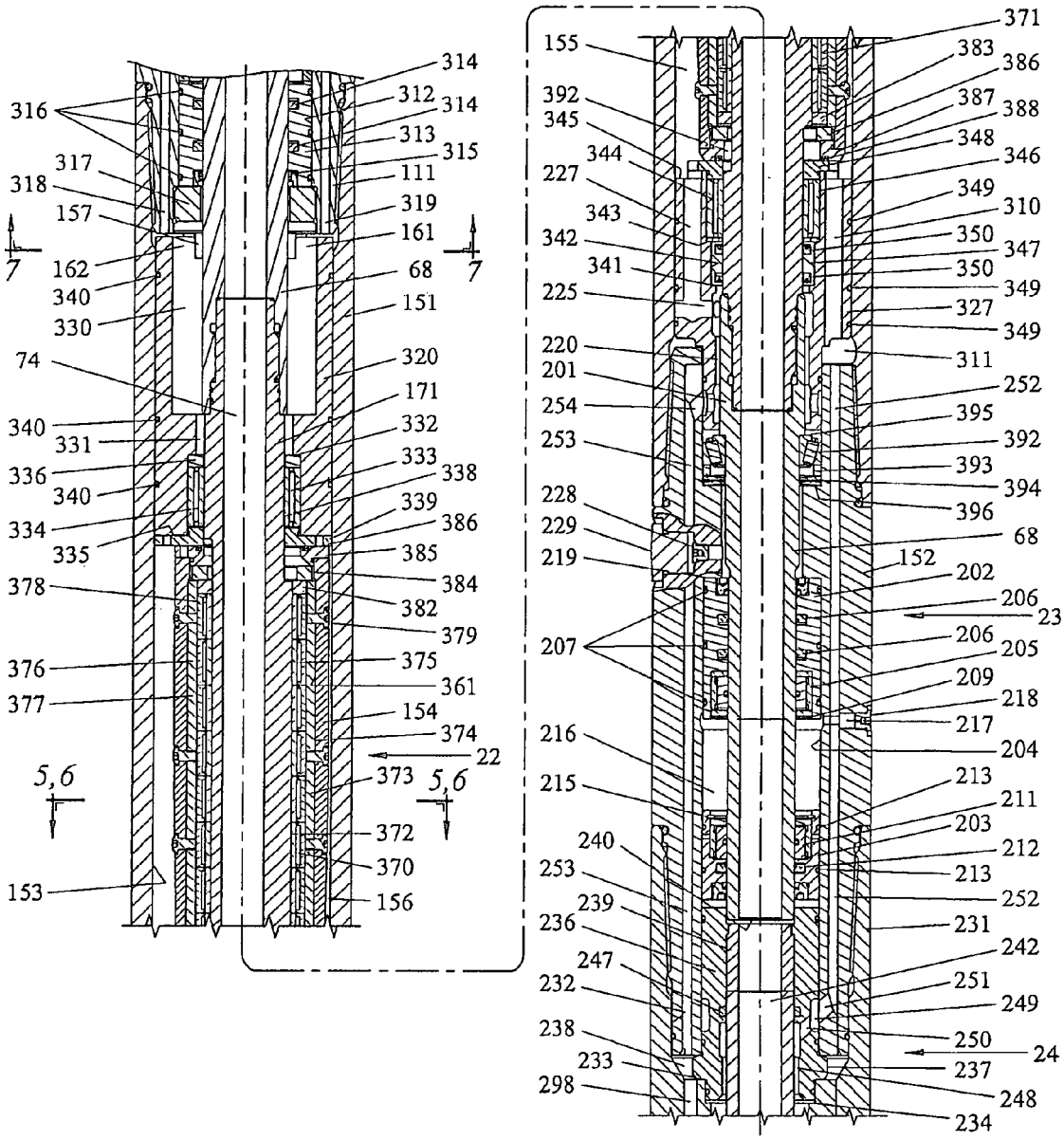
FIG. 4A is a side cross-sectional view, taken along the longitudinal axis of a compressor module of the percussion drill assembly of FIG. 3.

Referring now to FIG. 1, a drilling system S according to the present invention is installed at the bottom of a string of drill pipe D of a drilling apparatus A in a drilling rig R at an earth surface E. The drill pipe D extends down into an earth formation F.

As shown in FIGS. 2 and 3, a percussion drilling assembly 10 according to the present invention has four components, or modules, connected in series: a power module 11, a compressor module 12, an impact module 13, and a drill bit 14. The power module 11 has a backhead 15, a motor segment 16, a drive shaft segment 17, and a bearing segment 18. The compressor module 12 has an anchor segment 21, an eccentric segment 22, and a connector segment 23. The impact module 13 has a fluid communication segment 24, an impact piston segment 25, a chuck 26, and a bit adapter 27.

A mud motor located in the motor segment 16 is rotated by the downwardly flowing drilling fluid or mud, supplied via a drill string of drill pipe D to the backhead 15, so as to rotate a drive shaft located in the drive shaft segment 17. The rotation of the drive shaft causes the radial reciprocation of a gas compressor piston in the eccentric segment 22, and the compression and expansion of the gas causes the reciprocation of the impact piston located in the impact piston segment 25 for delivering cyclic impacts to the drill bit 14 via the bit adapter 27. The drill bit 14 can be any suitable drill bit, e.g., but not limited to, a tricone rotary drill bit, or a solid percussion drill bit. The upper end portion of the backhead 15 is provided with external threads for engagement with the internal threads of a piece of drill pipe D at the lower end of a string of drill pipe.

Referring now to FIG. 4A, a lower end of a housing 111 of the anchor segment 21 has a reduced external diameter portion with external threads for engagement with the internally threaded box of the upper end of a tubular housing 151 of the eccentric segment 22. The lower end of the housing 151 is a box having internal threads for engaging with the external threads on the reduced external diameter portion of the upper end of a housing 152 of the connector segment 23. The space between the housing 151 and a rotary shaft 68 (connected to the drive shaft segment 17) is in the form of an elongated annular compartment 153 having a longitudinal axis which is coincident with a longitudinal axis of the rotary shaft 68. An annular compressor piston 154, having an internal diameter larger than the external diameter of an adjacent portion of the rotary shaft 68, an external diameter smaller than the internal diameter of the radially adjacent portion of the housing 151, and a longitudinal length less than the longitudinal length of the elongated compartment 153, is positioned about the rotary shaft 68 for reciprocating motion within the elongated compartment 153 perpendicular to the longitudinal axis of the elongated compartment 153. The compressor piston 154 divides the elongated compartment 153 into a first fluid compression chamber 155 and a second fluid compression chamber 156, with the compression chambers 155 and 156 being substantially fluidly isolated from each other within the elongated compartment 153 by the presence of the compressor piston 154.

Figure 7:
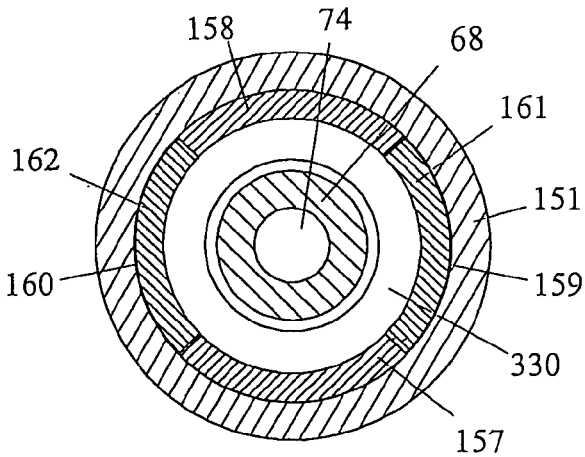
FIG. 7 is a cross-sectional view along line 7—7 of FIG. 4A.
Figure 8:
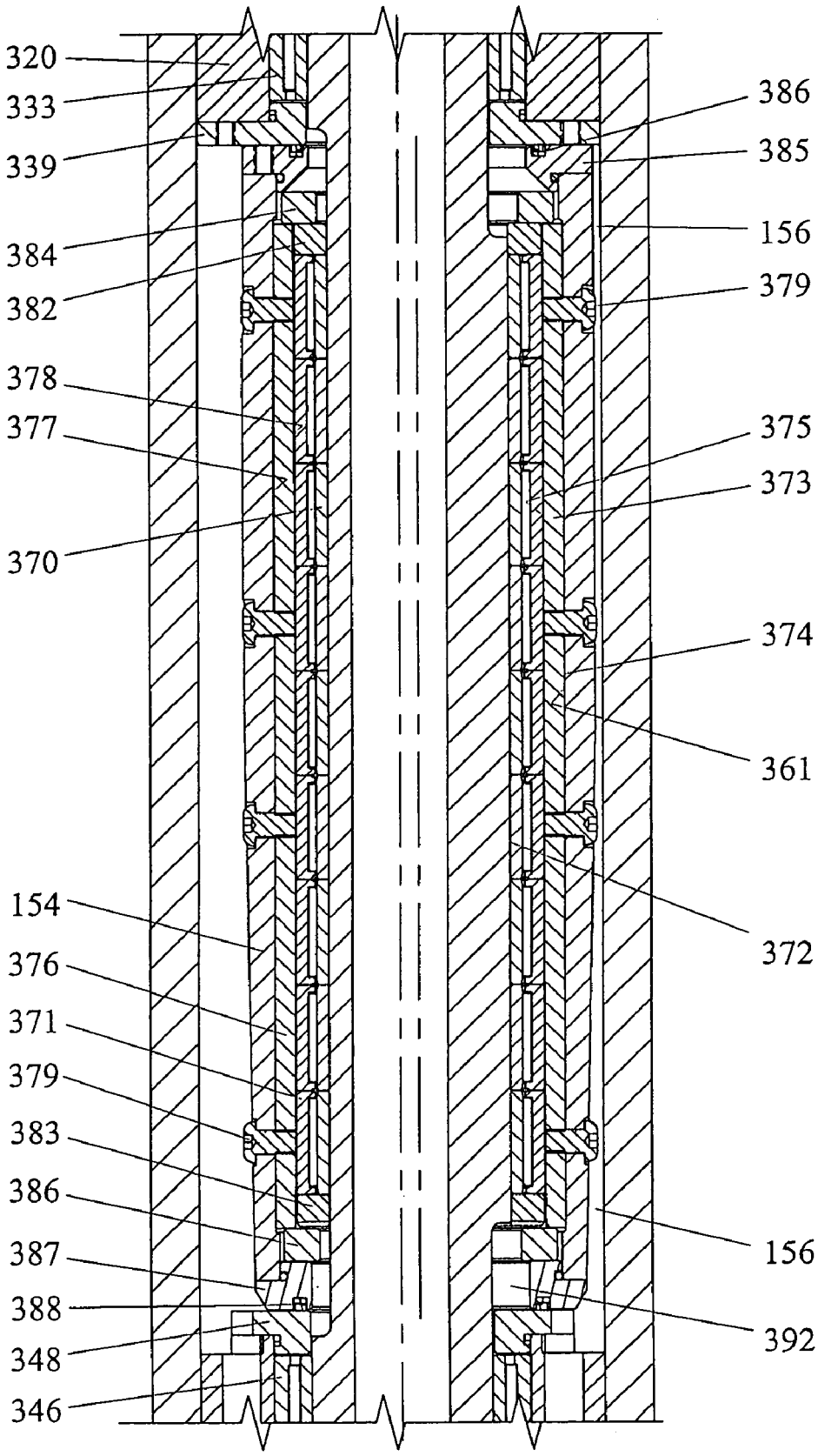
FIG. 8 is a side cross-sectional view along line 8—8 of part of the compressor module of FIG. 6.

As shown in FIGS. 4A and 7, the annular housing 111 has two downwardly extending arcuate segments 157 and 158, each being slightly less than 90° in arcuate length and being circumferentially separated from each other by first and second arcuate spaces 159 and 160, with each of the arcuate spaces 159 and 160 having an arcuate length of slightly more than 90°. The upper end of an anchor adapter 320 is in the form of two upwardly extending arcuate segments 161 and 162, each being slightly less than 90° in arcuate length and being circumferentially spaced apart from each other by slightly more than 90°, so that the arcuate segment 161 of 320 fits within the first arcuate space 159 between the arcuate segments 157 and 158 of the housing 111, and the arcuate segment 162 of 320 fits within the second arcuate space 160 between the arcuate segments 157 and 158 of the housing 111. Any suitable number of accurate segments can be employed. Utilization of at least two arcuate segments on each of the housing 111 and 320 reduces the loading on eccentric support bearings 334, 346.

Figure 5:
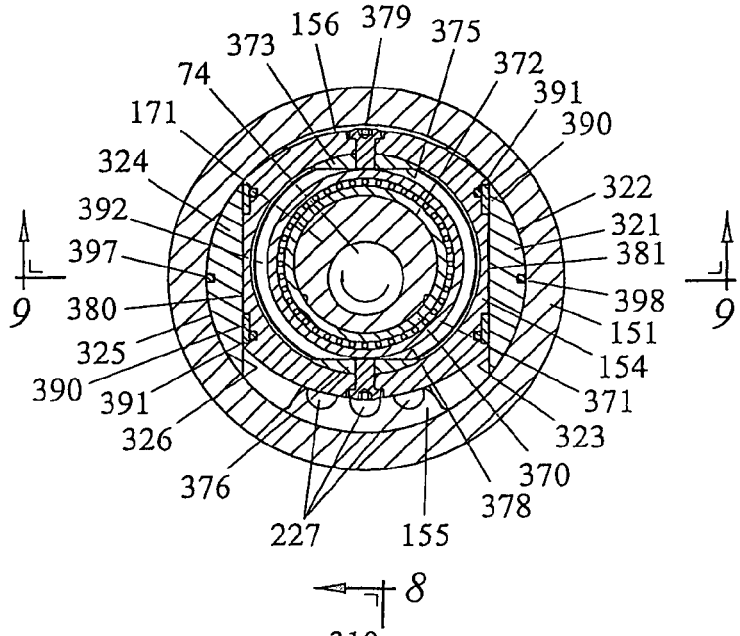
FIG. 5 is a cross-sectional view along line 5—5 of FIG. 4A.
Figure 6:
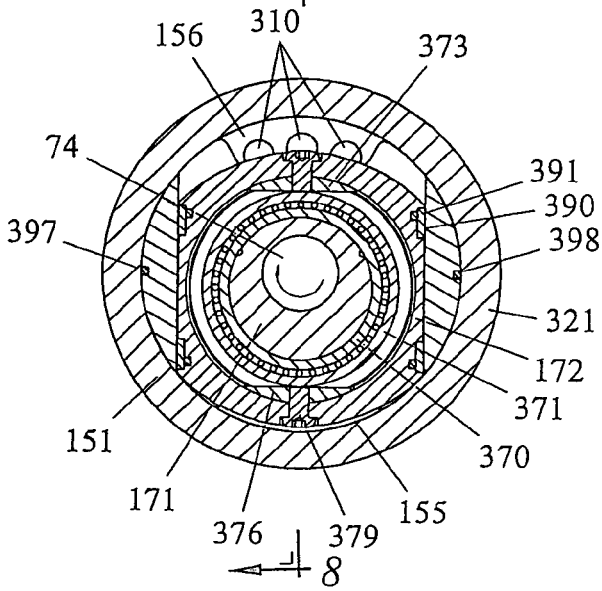
FIG. 6 is a cross-sectional view along line 6—6 of FIG. 4A.
Figure 9:
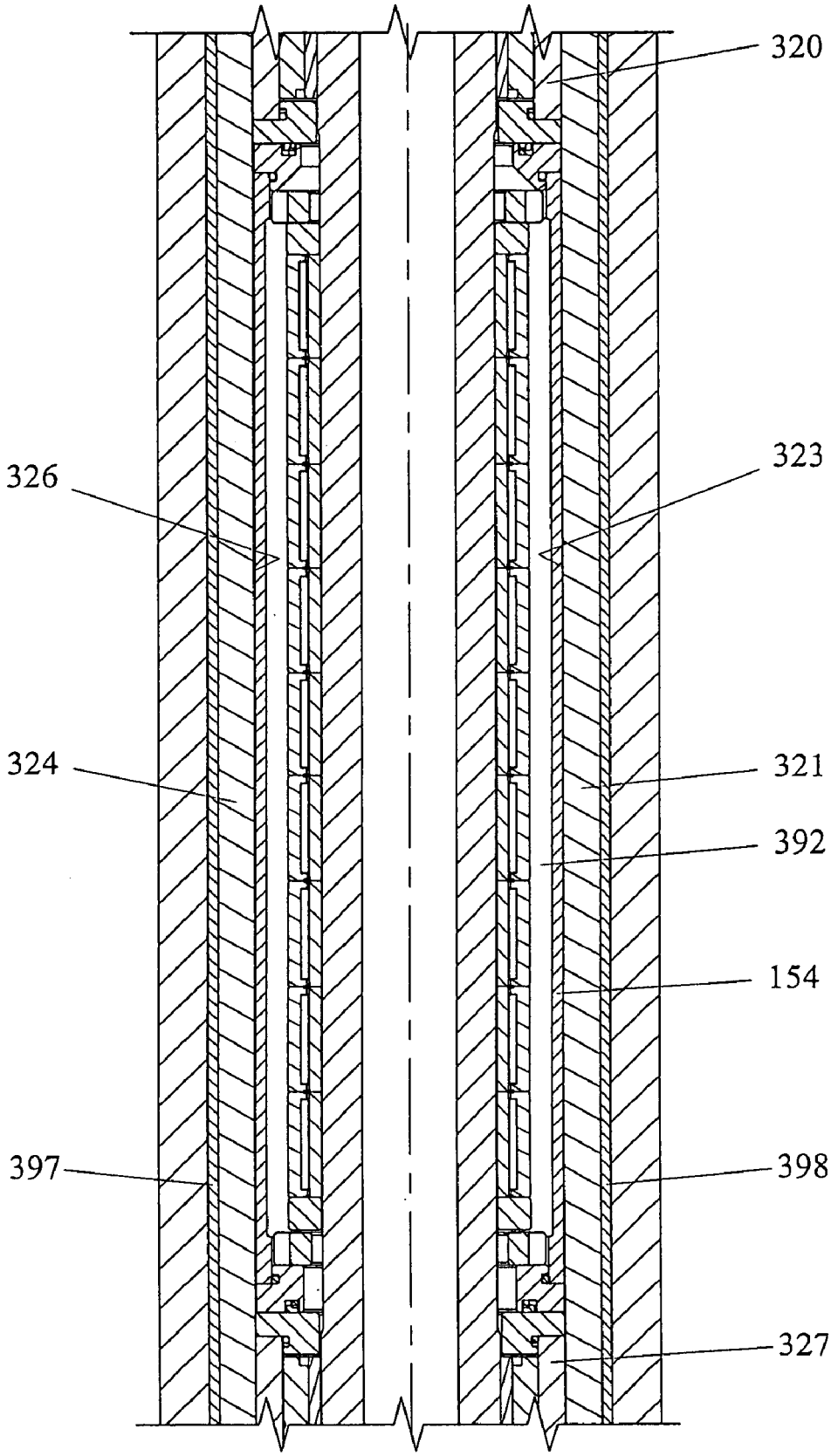
FIG. 9 is a side cross-sectional view along line 9—9 of part of the compressor module of FIG. 5.

Referring to FIGS. 5 and 9, a first anti-rotation member 321 has an outer surface 322 with a radius substantially equivalent to the inner radius of the housing 151, and an inner surface 323 that is flat; and a second anti-rotation member 324 has outer surface 325 with a radius substantially equivalent to the inner radius of the housing 151, and an inner surface 326 that is flat. Anti-rotation members 321 and 324 are attached to opposing flat surfaces on the anchor adapter 320 and a fluid distributor 327 such that surfaces 323 and 326 are parallel to each other. O-rings 397 and 398 are interposed between outer surfaces 322 and 325 and the inner radius of housing 151 to sealingly isolate chambers 155 and 156.

A seal carrier 313 shown in FIG. 4A has an outer diameter substantially equivalent to a bore 312 of the housing 111. One or more seals 314, and seal 315, are interposed between the bore of seal carrier 313 and the outer surface of the shaft 68. A plurality of O-rings 316 are interposed between the outer surface of seal carrier 313 and the bore 312 of the housing 111. The seal carrier 313 is retained in bore 312 of housing 111 by a retainer 317. The seal carrier 313, seals 314 and 315, and O-rings 316 maintain a fluid separation between the chamber 330 and the interior compartment of the housing 111. Passages 318 and 319 communicate between the chamber 330 and oil fill ports (not shown) through the side wall of the housing 111 allowing the chamber 330 to be filled with lubricating oil after assembly.

The anchor adapter 320 has a chamber 330, a passage 331, a shoulder 332, a bore 333, and a face 335. A sealing element 336 is interposed between the bore 333 and a surface 338 of a shaft 171, and between shoulder 332 and the bearing 334 which is interposed between the bore 333 and the surface 338 of the shaft 171, and between sealing element 336 and a retainer plate 339. The retainer plate 339 is removably attached to the face 335 of the anchor adapter 320. A plurality of O-rings 340 are positioned between the exterior cylindrical surface of the anchor adapter 320 and the inner wall of housing 151 to form a fluid seal therebetween. The fluid distributor 327 has flow passages 220, 225, 227, and 310, and a shoulder 341, a bore 342, a shoulder 343, a bore 344, and a face 345. A seal carrier 347 is interposed between the bore 342 and the surface of the shaft 171, and between the shoulder 341 and the bearing 346. The bearing 346 is interposed between the bore 344 and the surface of the shaft 171, and between the shoulder 343 and the retainer plate 348. The retainer plate 348 is removably attached to the face 345 of the fluid distributor 327. A plurality of O-rings 349 are positioned between the exterior cylindrical surface of the fluid distributor 327 and the inner wall of the housing 151 to form a fluid seal therebetween. One or more seals 350 are positioned between the interior cylindrical surface of the seal carrier 347 and the surface of shaft 171 to form a fluid seal therebetween.

The compressor piston 154 and an intermediate longitudinal segment 171 of the rotary shaft 68 within the elongated compartment 153 serve as components of an eccentric, which converts the rotary motion of the rotary shaft 68 into a transversely reciprocating motion of the compressor piston 154. Referring to FIGS. 4A and 5, the compressor piston 154 is an annular piston having an inner annular wall 361. The intermediate longitudinal segment 171 of the rotary shaft 68 has an eccentric portion 372 with an external diameter which is less than the internal diameter of the compressor piston 154. A plurality of bearing inner rings 370 is disposed along the eccentric portion 372. An equal number of rolling element bearings 371 is also disposed along the eccentric portion 372 such that each rolling element bearing 371 is aligned with a corresponding inner ring 370. A first bearing plate 373 has an outer surface 374 with a radius that is substantially equivalent to the inner radius of compressor piston 154 and an inner surface 375 that is flat. A second bearing plate 376 has an outer surface 377 with a radius that is substantially equivalent to the inner radius of compressor piston 154 and an inner surface 378 that is flat. First and second bearing plates 373 and 376 are attached to the inner wall 361 of compressor piston 154 with a plurality of screws 379 such that the flat surfaces 375 and 378 are parallel to each other and perpendicular to flat surfaces 380 and 381 on the compressor piston 154. The external diameter of the rolling element bearings 371 is only slightly less than the perpendicular distance between parallel flat surfaces 375 and 378 of bearing plates 373 and 376. A first thrust ring 382 is disposed at one end of the plurality of rolling element bearings, and a second thrust ring 383 is disposed at the opposite end of the plurality of rolling element bearings. The thrust ring 382 is located and retained inside compressor piston 154 by bearing thrust plate 384 and end plate 385, and thrust ring 383 is located and retained inside compressor piston 154 by bearing thrust plate 386 and end plate 387. The thrust rings may, optionally, be spacer rings that [either as thrust rings or as spacer rings] limit the axial movement of the inner rings 370 and of the rolling element bearings 371. The end plate 385 is removably attached to one end face of the compressor piston 154. The end plate 387 is removably attached to the opposite end face of the compressor piston 154. A sealing element 386 is interposed between the face of the end plate 385 and the retainer plate 339. A sealing element 388 is interposed between the face of the end plate 387 and the retainer plate 348. Rotation of the shaft segment 171 causes the eccentric portion 372 to force the inner rings 370 and rolling element bearings 371 first against the flat surface 375 of the bearing plate 373 and then alternately against the flat surface 378 of the bearing plate 376, causing the compressor piston 154 to reciprocate in a direction perpendicular to the longitudinal axis of the compartment 153. The distance between the flat surfaces 323 and 326 of the anti-rotation members 321 and 324 is only slightly greater than the distance between the flat surfaces 380 and 381 on the compressor piston 154. A plurality of bearing elements 390 and sealing elements 391 are disposed in cavities within the flat surfaces 380 and 381 of the compressor piston 154. The tendency of the compressor piston 154 to rotate about its longitudinal axis is resisted by contact between the bearing elements 390 and flat surfaces 323 and 326. The inertial loading on the shaft segment 171 and the bearings 371 is relatively less than the inertial loading in certain prior art systems because both the mass and the length of travel of compressor piston 154 are reduced as compared to certain prior art embodiments of U.S. Pat. No. 5,662,180. E.g., in certain aspects the compressor piston 154 has about ⅔ of the mass and ¼ of the length of travel, and therefore about ⅙ the inertial loading of certain of the prior art systems.

The space between the inner surfaces of compressor piston 154, the bearing plate 373, the bearing plate 376, the thrust ring 382, the thrust ring 383, the bearing thrust plate 384, the bearing thrust plate 386, the end plate 385, the end plate 387, and the external surface of the shaft 171 forms an elongated compartment 392. The inner rings 370, the rolling element bearings 371, the bearing 334, and the bearing 346 are completely contained within the compartment 392. Seals 350 isolate the compartment 392 from the elongated compartment 153. When the compressor is assembled, a finite quantity of lubricating oil is introduced into the compartment 392. Over a period of time, some of this lubricating oil will leak into the compartment 153. Chamber 330 is a fluid reservoir that replenishes the lubricant in the compartment 392 by controlled leakage past the sealing element 336. The combination of initial filling of the compressor, a separate reservoir 330, and a controlled metering through the sealing element 336 guarantees that the bearings within the compartment 392 will be adequately lubricated during the normal service life of the tool. Leakage past the element 336 is controlled by sizing and dimensions.

The upper end of a lower longitudinal segment 201 of the rotary shaft 68 is connected to the lower end of the intermediate segment 171 of the rotary shaft 68. A bearing 392, a spacer 393, and a belleville washer stack 394 are interposed between a shoulder 395 of the shaft segment 201 and a shoulder 396 of the housing 152. Rotating shaft 68 is thus located and axially constrained by the shoulder 396 of the housing 152 and a similar bearing and opposing shoulder (not shown) in the housing 111. An upper seal bearing assembly 202 and a lower seal bearing assembly 203 are positioned coaxially with the shaft segment 201, between the shaft segment 201 and the inner wall 204 of the housing 152 of the connector segment 23. The upper seal bearing assembly 202 has an upper shaft annular bearing assembly 205, upper shaft annular seals 206, and O-rings 207 mounted between the upper shaft annular bearing assembly 205 and the housing 152, and a retaining ring 209. The lower bearing seal assembly 203 has a lower shaft annular bearing assembly 211, a lower shaft annular seal 212, and O-rings 213 mounted between the lower shaft annular bearing assembly 203 and the housing 152, and a retaining ring 215. The upper seal bearing assembly 202 and the lower seal bearing assembly 203 are spaced apart along the longitudinal axis of the housing 152 so as to form an annular oil chamber 216 therebetween. A plurality of oil fill passageways 217 is provided in the wall of the housing 152 in order to permit oil to be selectively injected under pressure into the annular oil chamber 216. Plugs 218 are employed to removably seal the oil fill passageways 217.

The upper bearing seal assembly 202 is positioned against a downwardly facing annular shoulder 219 in the inner wall 204 of the housing 152, so that the annular fluid passageway 220 formed between the inner wall 204 of the housing 152 and the portion of the shaft segment 201 above the shoulder 219 is isolated from the oil chamber 216. A gas charge valve 228 is positioned in the wall of the housing 152 in communication with the fluid passageway 220 so that the fluid compression chamber 155 and the passageways 220 and 227 can be filled with a gas under pressure (in one aspect, gas at or above superatmospheric pressure). A valve cap 229 is mounted over the valve 228 to protect the valve 228.

Figure 4B:
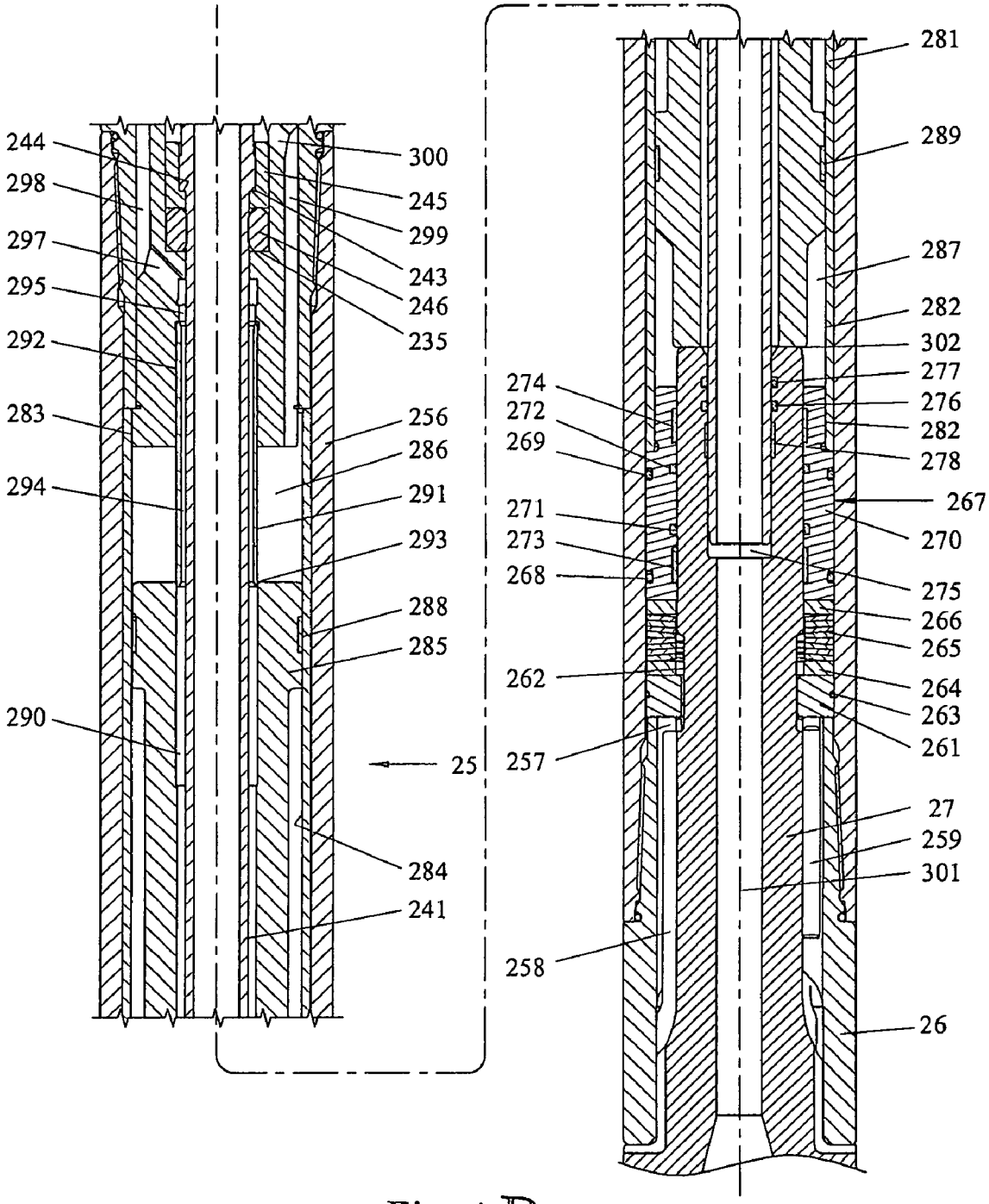
FIG. 4B is a side cross-sectional view of an impact module of the percussion drill assembly of FIG. 3.

Referring now to FIGS. 4A and 4B, the bottom end portion of the housing 152 of the connector segment 23 has a reduced external diameter with external threads which mate with internal threads in the box at the upper end of the housing 231 of the fluid communication segment 24. The inner wall 232 of the housing 231 has an upper upwardly facing annular shoulder 233, an intermediate upwardly facing annular shoulder 234, and a lower upwardly facing annular shoulder 235. An annular bearing seal retainer 236, which is positioned in the lower end portion of the housing 152 and in the upper end portion of the housing 231, has a radially outwardly extending flange 237, the upper annular surface of which engages the bottom end of the housing 152 and the lower annular surface of which engages the upper shoulder 233. Thus, the axial position of the bearing seal retainer 236 is firmly fixed when the housings 152 and 231 are assembled together. The external diameter of the annular flange 237 is less than the outer diameter of the upper shoulder 233, forming an annular cavity 238 between the lower end of the housing 152 and the upper shoulder 233. An annular bushing 239 is positioned coaxially within a longitudinal passageway through the retainer 236, with the inner diameter of the bushing 239 being smaller than the external diameter of the bottom end 240 of the rotary shaft 68, so that the bottom end portion of the rotary shaft 68 is positioned within the portion of the retainer 236 above the bushing 239 so that the rotary shaft 68 can rotate with respect to the bushing 239.

The top end portion of a stationary tubular shaft 241 is positioned within the portion of the retainer 236 below the bushing 239, so that the stationary tubular shaft 241 is coaxial with the rotary shaft 68, with the axial opening in the bushing 239 providing uninterrupted communication between the axial passageway 74 in the rotary shaft 68 and the axial passageway 242 in the stationary tubular shaft 241. The stationary shaft 241 has a downwardly facing external annular shoulder 243 which mates with an upwardly facing internal annular shoulder 244 of the annular seating element 245. A compression ring 246 is positioned between the bottom of the seating element 245 and the lower upwardly facing annular shoulder 235, thereby pressing the upper end of the stationary shaft 241 into sealing engagement with the seal 247 located in the inner wall of the annular bearing seal retainer 236 just below the bushing 239. The diameter of the inner wall of the annular bearing seal retainer 236 below the seal 247 is enlarged so as to provide an annular gap 248 between the external surface of the stationary shaft 241 and the inner wall of the lower portion of the annular bearing seal retainer 236. An annular groove 249 is formed in the outer periphery of the annular bearing seal retainer 236, and a plurality of passageways 250 extend radially inwardly from the annular groove 249 to the annular gap 248. An arcuate slot 251 is formed in the inner wall of the housing 152 so as to confront a portion of the annular groove 249. A passageway 252 is formed within the wall of the housing 152 to extend parallel to the longitudinal axis of the rotary shaft 68 from the arcuate slot 251 to the top end of the housing 152, and thereby provide fluid communication between the fluid compression chamber 156 and the annular gap 248. A passageway 253 is formed within the wall of the housing 152 to extend parallel to the longitudinal axis of the rotary shaft 68 from the annular gap 238 to a radially extending passageway 254. The inner end of the radial passageway 254 is open to the annular gas passageway 220, thereby providing fluid communication between the upper fluid compression chamber 155 and the annular gap 238.

The bottom end portion of the housing 231, as shown in FIG. 4B, of the fluid communication segment 24 has a reduced external diameter with external threads which mate with the internal threads in the box at the upper end of the housing 256 of the impact piston segment 25. The bottom end portion of the housing 256 of the impact piston segment 25 is a box having internal threads which mate with the external threads on the reduced external diameter upper portion of the chuck 26 to secure the chuck 26 to the housing 256. The chuck 26 has a plurality of longitudinally extending grooves 257 in its inner surface, with each groove 257 confronting a longitudinally extending groove 258 in the external surface of an intermediate portion of the drill bit adapter 27. Each pairing of a groove 257 and a groove 258 is provided with an elongated drive pin 259, whereby the rotation of the housing 256 by the drill string causes the corresponding rotation of the chuck 26 and the drill bit adapter 27, while the drill bit adapter 27 can move upwardly and downwardly along the longitudinal axis of the drill assembly with respect to the chuck 26. The drill bit adapter 27 is positioned coaxially within the chuck 26 and the housing 256 and extends upwardly beyond the top end of the chuck 26 into the housing 256. An annular retainer ring 261 for the drill bit adapter 27 is positioned on the upper end of the chuck 26 and extends radially inwardly into a circumferentially extending annular groove 262 formed in the exterior surface of the drill bit adapter 27. The length of the annular groove 262, parallel to the longitudinal axis of the drill assembly, is substantially greater than the corresponding longitudinal length of the retainer ring 261, thereby permitting the drill bit adapter 27 to move downwardly until the upper surface of the retainer ring 261 contacts the upper side wall of the annular groove 262. An O-ring 263 is positioned between the exterior surface of the retainer ring 261 and the inner wall of the housing 256. A lower annular spacer 264, a plurality of Belleville washers 265, and an upper annular spacer 266 are positioned coaxially with the drill bit adapter 27 between the retainer ring 261 and the lower end of the bit adaptor annular bearing seal assembly 267. Two O-rings 268 and 269 are positioned between the exterior cylindrical surface of the body 270 of the bearing seal assembly 267 and the inner wall of housing 256 to form a fluid seal therebetween. The seals 271 and 272 are spaced apart along the longitudinal axis of the drill bit assembly between a lower wear ring 273 and an upper wear ring 274, with the elements 271–274 being positioned between the inner surface of the body 270 of the bearing seal assembly 267 and the external surface of the upper portion of the drill bit adapter 27 to form a fluid seal therebetween. The lower end of the stationary tubular shaft 241 extends into an annular recess 275 in the top end portion of the drill bit adapter 27. The seals 276 and 277 are spaced apart along the longitudinal axis of the drill bit assembly above a wear ring 278, with the elements 276–278 being positioned between the inner cylindrical surface of the recess 275 in the drill bit adapter 27 and the external surface of the lower portion of the tubular stationary shaft 241 to form a fluid seal therebetween.

A cylindrical annular wear sleeve 281 is positioned coaxially with housing 256 with the exterior cylindrical surface of the wear sleeve 281 being in contact with the interior surface of the housing 256, with the lower end of the wear sleeve 281 extending into an annular recess 282 in the outer circumference in the top end portion of the body 270 of the bearing seal assembly 267, and with the upper end of the wear sleeve 281 extending into an annular recess 283 in the outer circumference in the bottom end portion of the housing 231 of the fluid communication segment 24. The interior of the wear sleeve 281 between the top end of the body 270 of the bit adaptor annular bearing seal assembly 267 and the bottom end of the housing 231 of the fluid communication segment 24 constitutes an elongated compartment 284.

A hammer piston 285, having an internal diameter larger than the external diameter of the adjacent portion of the stationary shaft 241, an external diameter only slightly smaller than the internal diameter of the radially adjacent portion of the wear sleeve 281, and a longitudinal length substantially less than the longitudinal length of the elongated compartment 284, is positioned about and coaxially with the stationary shaft 241 for reciprocating motion within the elongated compartment 284 along the longitudinal axis of the elongated compartment 284. The hammer piston 285 divides the elongated compartment 284 into an upper hammer piston fluid drive chamber 286 and a lower hammer piston fluid drive chamber 287, with the drive chambers 286 and 287 being substantially fluidly isolated from each other within the elongated compartment 284 by the presence of the hammer piston 285. The hammer piston 285 is free floating, i.e., its movements within the compartment 284 are determined only by the fluid pressures in chambers 286 and 287 as the hammer piston 285 is not mechanically connected to any other mechanical component, e.g., the drill bit adapter 27. An upper wear ring 288 is provided in the external periphery of the top end portion of the hammer piston 285, while a lower wear ring 289 is provided in the external periphery of the bottom end portion of the hammer piston 285, in order to provide replaceable bearing surfaces for sliding contact between the external surface of the hammer piston 285 and the internal surface of the wear sleeve 281. The internal diameter of the hammer piston 285 is sufficiently larger than the external diameter of the adjacent portion of the stationary shaft 241 so as to form an annular passageway 290 extending from the bottom end of the hammer piston 285 to the top end of the hammer piston 285. A plurality of grooves 302 are formed in the bottom end of the hammer piston 285 so as to extend radially outwardly from the annular passageway 290 so as to provide fluid communication from the annular passageway 290 to the lower hammer piston chamber 287 even when the bottom end of the hammer piston 285 is positioned on the upper end of drill bit adapter 27. Thus, the lower end of passageway 299 constitutes a first compressor port in the upper hammer piston chamber 286, while the lower end of the passageway 290 constitutes a second compressor port in the lower hammer piston chamber 287, such that the compressor produces a high fluid pressure in the first compressor port and the upper hammer piston chamber 286 and a low fluid pressure in the second compressor port and the lower hammer piston chamber 287 during a first or impact half cycle of operation of the compressor, and the compressor produces a low fluid pressure in the first compressor port and the upper hammer piston chamber 286 and a high fluid pressure in the second compressor port and the lower hammer piston chamber 287 during a second or retraction half cycle of operation of the compressor.

A cylindrical tube 291 is positioned exteriorly of and coaxially with the stationary shaft 241 with the upper end of the tube 291 being sealingly mounted in an annular recess 292 in the lower end of housing 152, while its lower end telescopes into the top end portion of the annular passageway 290 between the hammer piston 285 and the stationary shaft 241. Hammer piston 285 has a chamfer 293 at the junction of the top end surface of the hammer piston 285 and the top end of the inner wall surface of the hammer piston 285. The chamfer 293 is in the form of a downwardly and inwardly extending surface which serves to guide the bottom end of the tube 291 into the annular passageway 290. The outer bottom edge portion of the tube 291 can also be provided with a mating chamfer. The radial thickness of the tube 291 is less than the radial dimension of the passageway 290, while the external diameter of the tube 291 is slightly less than the internal diameter of the hammer piston 285 so that the tube 291 can readily enter the opening in the top end of the hammer piston 285 and thereby prevent fluid communication between the passageway 290 and the upper hammer piston chamber 286 while the tube 291 is engaged with the hammer piston 285. The internal diameter of the tube 291 is larger than the external diameter of the radially adjacent portion of the stationary shaft 241 to form an annular fluid passageway 294 extending upwardly from the passageway 290 to the top end of the tube 291. An annular groove 295 is formed in the inner surface of the lower portion of the housing 231 radially adjacent an upper portion of the tube 291. A radial passageway 297 is formed in the wall of the housing 231 so as to extend radially outwardly from the annular groove 295 to the lower end of a longitudinal passageway 298 which is formed in the wall of the housing 231 so as to extend parallel to the longitudinal axis of the drill assembly 10 from the radial passageway 297 to open in the annular cavity 238, thus providing fluid communication between the annular cavity 238, defined by the housing 152 and the shoulder 233, and the lower hammer piston drive chamber 287. A longitudinal passageway 299 is formed in the wall of the housing 231 so as to extend parallel to the longitudinal axis of the drill assembly 10 from the bottom end of the housing 231 to a radial passageway 300 in the inner surface of the housing 231, thus providing fluid communication between the annular passageway 248, defined by the interior surface of the annular bearing seal retainer 236 and the exterior surface of the top end of the stationary shaft 241, and the upper hammer piston drive chamber 286.

In operation, the percussion drilling assembly 10 of the drill system S is connected to the bottom end of a piece of drill pipe D of a string of such pipe and lowered into the borehole until the drill bit 14 rests on the bottom of the borehole. The drill string is then rotated to cause a corresponding rotation of the drill bit 14, thereby performing rotary drilling. Drilling fluid or mud is passed downwardly through the drill string into and through axial passageways in the backhead 15, the motor segment 16, the drive shaft segment 17, and the bearing segment 18 into the axial flow passageway 74 in the tubular rotary shaft 68. The drilling mud passes from axial passageway 74 through the axial opening in the bushing 239 into the axial passageway 242 in the stationary shaft 241, then into the axial passageway 301 extending through the drill bit adapter 27, to and through the drill bit 14. The exhausted drilling mud then picks up drilling debris and passes upwardly through an annular space between the borehole wall and the drill apparatus and then through the annular space between the borehole wall and the drill string. The passage of drilling mud through the motor segment 16 causes the motor to rotate the rotary shaft 68. The drilling fluid acts as a cooling medium for the system. As the engagement of arcuate segments 157 and 158 with arcuate segments 161 and 162 and the engagement of bearing elements 390 and surfaces 323 and 326 prevents the rotation of the compressor piston 154 with respect to the drill assembly 10, the rotation of the rotary shaft 68 causes eccentric 372 to reciprocate the compressor piston 154 in a direction perpendicular to the axis of compartment 153. This reciprocation results in cyclical impacting of the drill bit. In like manner, with driving systems according to the present invention, this reciprocation results in cyclical impacting on an item being driven into the earth, e.g., a pipe, pile, or casing.

Referring to FIGS. 4A, 4B, 5, and 6, during the impact half of the cycle of operation of the compressor piston 154, the rolling element bearings force the compressor piston 154 to move into the compression chamber 156, and the gas in the compression chamber 156 is compressed, increasing its pressure, while the pressure of the gas in the compression chamber 155 is decreased through expansion. The increased gas pressure in the compression chamber 156 is transmitted through longitudinal passageways 310, the annular groove 311, the longitudinal passageway 252, the arcuate slot 251, the annular groove 249, the radial holes 250, the annular passageway 248, the radial passageway 300, and the longitudinal passageway 299 to the upper hammer piston drive chamber 286. Simultaneously, gas in the lower hammer piston chamber 287 passes upwardly through the annular passageway 290, the annular passageway 294, the annular groove 295, the radial passageway 297, the longitudinal passageway 298, the annular cavity 238, the longitudinal passageway 253, the radial passageway 254, the annular passageway 220, the radial passageway 225, and the longitudinal passageway 227 into the compression chamber 155, due to the reduction in the gas pressure in the compression chamber 155. The resulting pressure differential between the increased pressure in the upper hammer piston chamber 286 and the decreased pressure in the lower hammer piston chamber 287 causes the hammer piston 285 to move rapidly toward an anvil surface represented by the top end of the drill bit adapter 27, striking the anvil surface, and transmitting an impact force through the drill bit adapter 27 to the drill bit 14. Thus, the system is designed for the hammer piston 285 to strike the anvil surface of the drill bit adapter 27 once for each revolution of the rotary shaft 68.

In certain aspects, the length of the axial motion of the hammer piston 285, during normal operations with the drill bit 14 in contact with the borehole bottom, and the axial length of the tube 291 below the bottom end of the housing 231 are selected so that during such normal operations of the compressor piston 154, at least the lower end of the tube 291 is always within the annular passageway 290 in sealing engagement with the hammer piston 285, permitting the compressor piston 154 to freely move through its reciprocating motions while isolating the fluid passageway 290 from the upper hammer piston chamber 286 until just immediately prior to the bottom end of the hammer piston 285 striking the anvil surface at the top end of the drill bit adapter 27, at which time a small clearance is established between the bottom end of the telescoping tube 291 and the chamfer 293. This clearance permits a small amount of fluid communication between the upper hammer piston drive chamber 286 and the passageway 290. As the pressure in the lower hammer chamber 287 is greater than the pressure in the upper hammer chamber 286 at the moment of the impact of the hammer piston 285 against the anvil surface at the top end of the drill bit adapter 27, this permits the pressure in the lower hammer chamber 287 to establish a minimum initial pressure in the upper hammer piston chamber 286 at the moment of impact of the hammer piston 285 against the drill bit adapter 27. This minimum initial pressure in the upper hammer piston chamber 286 prevents overstroking and "floating" of the hammer piston 285 during the retraction stroke, which would result in a loss of energy.

Referring to FIGS. 4A, 4B, 5, and 6, during the retraction half of the cycle of operation of the compressor piston 154, the rolling element bearings force the compressor piston 154 to move into the compression chamber 155, and the gas in the compression chamber 155 is compressed, increasing its pressure, while the pressure of the gas in the compression chamber 156 is decreased through expansion. The increased gas pressure in the compression chamber 155 is transmitted through the longitudinal passageways 227, the radial passageway 225, the annular passageway 220, the radial passageway 254, the longitudinal passageway 253, the annular cavity 238, the longitudinal passageway 298, the radial passageway 297, the annular groove 295, the annular passageway 294, the annular passageway 290, and the grooves 302 into the lower hammer piston drive chamber 287. Although there is initially a clearance between the bottom end of the tube 291 and the chamfer 293 at the top of the hammer piston 285, the gas flow through the clearance is small compared to the gas flow through the annular passageway 290 into the lower hammer piston drive chamber 287 so that the hammer piston 285 is quickly raised to the point where the clearance is eliminated, and thereafter the total flow of the higher pressure gas goes to the lower hammer piston drive chamber 287. Simultaneously, gas in the upper hammer piston chamber 286 passes upwardly through the longitudinal passageway 299, the arcuate slot 300, the annular passageway 248, the radial holes 250, the annular groove 249, the arcuate slot 251, and the longitudinal passageway 252, to the compression chamber 156, due to the reduction in the gas pressure in the compression chamber 156. The resulting pressure differential between the decreased pressure in the upper hammer piston chamber 286 and the increased pressure in the lower hammer piston chamber 287 causes the hammer piston 285 to move rapidly upwardly. In certain aspects, the range of motion of the hammer piston 285 is selected so that the upward motion of the hammer piston 285 during the retraction half cycle terminates without the top of the hammer piston 285 reaching the bottom end of the housing 231.

When the drill bit 14 is positioned out of contact with the bottom of the borehole, the drill bit 14 and the drill bit adapter 27 move axially downwardly with respect to the remainder of the drill apparatus until the upper surface of the retainer ring 261 contacts the upper side wall of the annular groove 262. This lower position of the drill bit adapter 27 permits the hammer piston 285 to move downwardly a greater distance during the next impact half of the cycle of operation of the compressor piston 154, resulting in a substantially greater clearance between the bottom end of tube 291 and the chamfer 293, to the extent that during the next retraction half cycle, this greater clearance effectively short-circuits the flow of the high pressure gas from the annular passageway 294 into the upper hammer piston drive chamber 286, preventing the raising of the hammer piston 285. Thus, the hammer piston 285 remains in this lower position until the drill bit 14 again contacts the bottom of the borehole, raising the drill bit adapter with respect to the remainder of the drill assembly 10, and thereby raising the hammer piston 285 until, upon the next retraction half cycle, the hammer piston 285 can be retracted upwardly as part of its normal operation. This permits a free circulation of the working gas in the closed fluid system without building up pressure or heat, while the drill bit 14 is not in contact with the borehole bottom.

In certain aspects, the hammer piston of systems according to the present invention is operated within ±20% or ±10% of the natural resonant frequency of the system. Approaches for an analysis of the operating cycle of such systems is disclosed in U.S. Pat. No. 5,662,180.

In certain embodiments gas is the fluid used in the closed system, with typical gases being air and/or nitrogen. Once the parameters are selected for achieving normal design operation at the natural frequency, and the drill assembly is lowered downhole, the actual operation can be altered from the normal design operation by varying the mud flow rate through the drill string, and thus the revolution rate of the mud motor. This will result as a corresponding variation in the frequency of operation.

Figure 10:
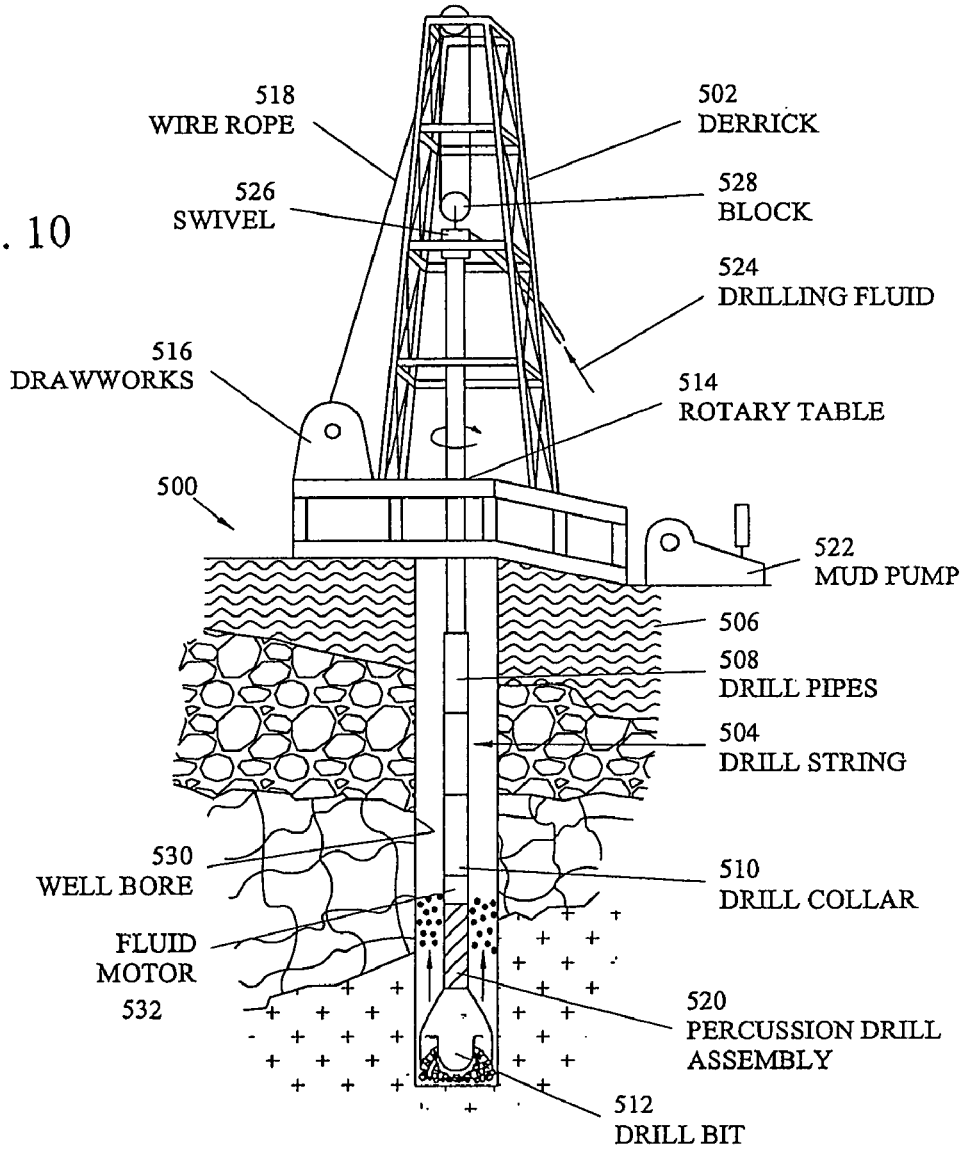
FIG. 10 is a side view partially in cross-section, of a drilling system according to the present invention.

The system 500 shown in FIG. 10 includes a derrick 502 from which extends a drillstring 504 into the earth 506. The drillstring 504 has drill pipes 508, drill collars 510, a percussion drill assembly 520 according to the present invention, and a drill bit 512. The percussion drill assembly 520 may be any such assembly according to the present invention described herein. A rotary table 514 rotates the drillstring 504 and a typical drawworks 516 has a wire rope apparatus 518 for supporting items in the derrick 502. A mud pump 522 supplies drilling fluid 524 to the bottomhole and typical equipment is used to removing cuttings from the drilling fluid 524. Adding percussion effected impact, rotary motion, and/or weight to the drill bit 512 excavates earth, rock, etc. to form a wellbore 530 extending down into the earth 506. In one aspect a part of the weight of the drill collars 510 is loaded on the bit 512. This weight is maintained within an appropriate range for drilling, controlling the tension of the wire rope using the drawworks 516. Rotation is transmitted to the drill bit 512 through the rotary table 514, the drill pipes 508, drill collars 510, and the percussion drilling assembly 520. In addition, the percussion drilling assembly 520 gives impact blows to the drill bit 512.

During drilling, the drilling fluid 524 stored at the surface is pressurized by the mud pump 522 and supplied to the percussion drilling assembly 520 through a swivel 526 supported by the wire rope apparatus 518 [which may include a travelling block 528], drill pipes 508 and drill collars 510 and thereby operates a fluid motor 532 [like any fluid motor described or referred to herein]. When the drilling fluid 524 passes through the motor 532, a rotor of the motor rotates in a stator of the motor. Its rotation is transmitted as described above to the percussion drilling assembly 520. Drilling fluid flows to the drill bit 512, and then is exhausted to the bottomhole through the passages through or nozzles on the drill bit 512. Circulation of the drilling fluid 524 transports earth and/or rock cuttings, debris, etc. from the bottomhole to the surface through an annulus between a well wall and the drillstring 504. The cuttings are removed from the drilling fluid 524 so that it may be re-circulated by the mud pump 522. Selective blows may be provided by selectively turning off the percussion: e.g., by opening a bypass orifice in the downhole motor so the motor stops turning; moving a member inside the tool to simulate "off collar" operation while the tool is still "on collar"; opening an internal gas bypass port so the impact piston stalls; closing one of the connecting ports between the compressor and the impact piston so the impact piston stalls; and/or reducing the drilling fluid flow so the impact is light enough to have negligible effects [e.g., running far off the optimum frequency]. Remote controls could be used for the options listed above.

The present invention, therefore, in some, but not necessarily all embodiments, provides a system for moving a drilling apparatus for drilling a borehole in a formation, said system including: a housing with a longitudinal axis; a movable member movably disposed within the housing, the movable member movable within the housing transversely to the longitudinal axis of the housing, the movable member positioned within the housing with a first space on a first side thereof and a second space on a second side thereof, the first space substantially fluidly isolated from the second space by the movable member, the movable member movable to compress gas in one of the first space and the second space while decompressing gas in the other of the first space or second space so that a charge of compressed gas exits from the housing to move an impact member for impacting the drill apparatus for drilling the wellbore; and the movable member movable continuously to provide a series of a plurality of movements of the impact member.

The present invention, therefore, provides in some, but not necessarily all embodiments, a percussion drill assembly for drilling a borehole in a formation, the percussion drill assembly including: an elongated housing assembly having a first end adapted to removably connect said drill assembly to a drill string, and a second end adapted to receive a drill bit; a first compartment formed within the housing assembly and having a longitudinal axis; a hammer piston positioned within the first compartment for reciprocal motion within the first compartment along the longitudinal axis of the first compartment, the hammer piston dividing said first compartment into a first chamber and a second chamber which are substantially fluidly isolated from each other within the first compartment by the presence of the hammer piston; a fluid compressor positioned within said housing assembly and having a first port in said first chamber and a second port in the second chamber; wherein a second compartment is formed within the housing assembly, the second compartment having a longitudinal axis; wherein the fluid compressor is a compressor piston positioned within the second compartment for reciprocal motion within the second compartment transverse to the longitudinal axis of the second compartment, the compressor piston dividing the second compartment into a third chamber and a fourth chamber which are substantially fluidly isolated from each other within the second compartment by the presence of the compressor piston; wherein the first port provides fluid communication with the third chamber, and the second port provides fluid communication with the fourth chamber; a driver mounted in the housing assembly and connected to the compressor piston so as to drive the compressor piston to produce a high fluid pressure in the first port and a low fluid pressure in the second port during a first half cycle of operation of the fluid compressor and to produce a low fluid pressure in the first port and a high fluid pressure in the second port during a second half cycle of operation of the fluid compressor; and wherein the driver is connected to the compressor piston to cause reciprocating movements of the compressor piston within the second compartment.

The present invention, therefore, provides in some, but not necessarily all, embodiments, a percussion drill assembly for drilling a borehole in a formation, the percussion drill assembly including an elongated housing assembly having a first end adapted to removably connect said drill assembly to a drill string, and a second end adapted to receive a drill bit, a first compartment formed within said housing assembly and having a longitudinal axis, a hammer piston positioned within said first compartment for reciprocal motion within said first compartment along the longitudinal axis of said first compartment, said hammer piston dividing said first compartment into a first chamber and a second chamber which are substantially fluidly isolated from each other within said first compartment by the presence of said hammer piston, a fluid compressor positioned within said housing assembly and having a first port in said first chamber and a second port in said second chamber, wherein a second compartment is formed within said housing assembly, said second compartment having a longitudinal axis, wherein said compressor has a compressor piston positioned within said second compartment for reciprocal motion within said second compartment transverse to the longitudinal axis of said second compartment, said compressor piston dividing said second compartment into a third chamber and a fourth chamber which are substantially fluidly isolated from each other within said second compartment by the presence of said compressor piston, wherein said first port provides fluid communication with said third chamber, and said second port provides fluid communication with said fourth chamber, a driver mounted in said housing assembly and connected to said compressor piston so as to drive said compressor piston to produce a high fluid pressure in said first port and a low fluid pressure in said second port during a first half cycle of operation of said first compressor and to produce a low fluid pressure in said first port and a high fluid pressure in said second port during a second half cycle of operation of said first compressor, wherein said driver is connected to said compressor piston to cause reciprocating movements of said compressor piston within said second compartment, seals for sealing said fluid compressor from fluid communication with any fluid received from the drill string, whereby said compressor fluid system is a closed fluid system, wherein said drill assembly is operable to impart an impact force to a drill bit, a high fluid pressure in said first chamber and a low fluid pressure in said second chamber causing a movement of said hammer piston toward said second chamber, wherein said drill assembly is operable to impart an impact force to a drill bit, a low fluid pressure in said first chamber and a high fluid pressure in said second chamber causes a movement of said hammer piston toward said first chamber, wherein said housing assembly comprises a bit adapter at said second end of said housing assembly for receiving a drill bit, said bit adapter having an anvil surface exposed to said compartment, wherein said drill assembly further comprises a drill bit removably connected to said bit adapter, whereby a predetermined extent of movement of said hammer piston in one of its directions of movement causes said hammer piston to strike said anvil surface and impart an impact blow to said bit adapter when said drill bit is in contact with a borehole bottom, wherein said driver is a fluid motor which is driven by a drilling fluid passed downwardly through a drill string to the drill assembly, and wherein the drilling fluid is exhausted from said fluid motor through said second end of said housing assembly and through said drill bit, wherein said fluid motor has a liquid inlet and a liquid outlet, a stator and a rotor positioned between said liquid inlet and said liquid outlet, said driver has a rotary shaft and said rotor is connected to said rotary shaft so that rotation of said rotor causes corresponding rotation of said rotary shaft, wherein the rotation of said rotary shaft drives said fluid compressor, and wherein said liquid inlet of said motor is connected to an inlet passageway in said first end of said housing assembly so that liquid from the drill string flows through said inlet passageway and then flows between said rotor to said liquid outlet to effect rotation of said rotor with respect to said housing assembly, thereby rotating said rotary shaft and driving said fluid compressor.

The present invention, therefore, provides in some, but not necessarily all, embodiments, a liquid-driven, gas-operated, percussion drill assembly for drilling a borehole in a formation, said drill assembly including an elongated housing assembly, said housing assembly having a first end and a second end opposite said first end, and a longitudinal axis extending from said first end to said second end, an end portion of said housing assembly at said first end being adapted for removably connecting said drill assembly to a drill string, said end portion having a first passageway extending therethrough for the passing of a liquid received from the drill string, an elongated first compartment formed within said housing assembly, said first compartment having a longitudinal axis which is at least generally parallel to the longitudinal axis of said housing assembly, a first piston positioned within said first compartment for reciprocal motion within said first compartment transverse to the longitudinal axis of said first compartment, said first piston dividing said first compartment into a first right chamber and a first left chamber which are substantially fluidly isolated from each other within said first compartment by the presence of said first piston, a first shaft having a longitudinal axis, said first shaft being rotatably mounted in said housing assembly with the longitudinal axis of said first shaft being at least generally parallel to the longitudinal axis of said housing assembly, said first shaft being engaged with said first piston such that rotation of said first shaft causes reciprocating movement of said first piston within said first compartment, a motor positioned in said housing assembly and having a liquid inlet and a liquid outlet, said motor having a stator and a rotor positioned between said liquid inlet and said liquid outlet, said rotor being connected to said first shaft so that rotation of said rotor causes corresponding rotation of said first shaft, said liquid inlet of said motor being connected to the first passageway in said end portion of said housing assembly so that liquid from said first passageway flows between said stator and said rotor to said liquid outlet to effect rotation of said rotor with respect to said housing assembly, thereby rotating said first shaft and reciprocating said first piston, an elongated second compartment formed within said housing assembly, said second compartment having a longitudinal axis which is at least generally parallel to the longitudinal axis of said housing assembly, a second piston positioned within said second compartment for reciprocal motion within said second compartment along the longitudinal axis of said second compartment, said second piston dividing said second compartment into a first upper chamber and a first lower chamber which are substantially fluidly isolated from each other within said second compartment by the presence of said second piston, a bit adapter having an anvil surface at a first end thereof and a drill bit receiving opening at a second end thereof, said bit adapter being removably attached to said second end of said housing assembly with said anvil surface of said bit adapter being exposed to said first lower chamber, a second passageway providing fluid communication between said first right chamber and a first one of said first upper chamber and said first lower chamber, a third passageway providing fluid communication between said first left chamber and a second one of said first upper chamber and said first lower chamber, seals for sealing said first and second compartments and said second and third passageways from fluid communication with said first passageway, whereby said first and second compartments and said second and third passageways constitute a closed fluid system, each of said first right chamber and said first upper chamber, said first left chamber and said first lower chamber, and said second and third passageways having gas therein, wherein movement of said first piston toward said first right chamber compresses the gas in said first right chamber and thus increases the pressure of the gas in said first right chamber, in said second passageway, and in said first one of said first upper chamber and said first lower chamber, thereby causing the movement of said second piston toward said second one of said first upper chamber and said first lower chamber, and wherein movement of said first piston toward said first left chamber compresses the gas in said first left chamber and thus increases the pressure of the gas in said first left chamber, in said third passageway, and in said second one of said first upper chamber and said first lower chamber, thereby causing the movement of said second piston toward said first one of said first upper chamber and said first lower chamber.

Figure 11:
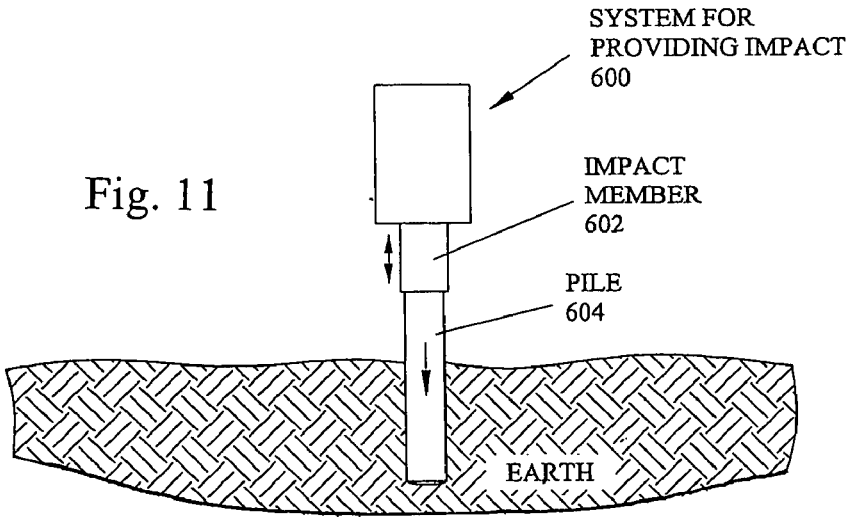
FIG. 11 is a side schematic view in cross-section, of a pile driving system according to the present invention.

FIG. 11 shows a system 600 according to the present invention with an impact member 602 for driving a pile 604 into the earth. The structure and apparatuses for accomplishing this in the system 600 are like those of any system according to the present invention described or disclosed herein, but rotation is not required. Drilling mud or fluid exiting from the fluid motor of the system may be used to assist in penetration of a pile through jetting action at the nose of the pile; or alternatively exiting mud may be returned to a mud reservoir through separate passages provided within the system.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of the invention and of the claims that follow as they may pertain to apparatus not materially departing from, but outside of, the literal scope of the invention as set forth in the following claims. Any patent or patent application referred to herein is incorporated fully herein for all purposes.

What is claimed is:

1. A system for providing cyclical impacts, said system comprising a housing with a longitudinal axis, an impact member adjacent the housing, a movable member movably disposed within the housing, the movable member movable within the housing transversely to the longitudinal axis of the housing, the movable member positioned within the housing with a first space on a first side thereof and a second space on a second side thereof, gas in the first space and gas in the second space, the first space substantially fluidly isolated from the second space by the movable member, the movable member movable to compress gas in one of the first space and the second space while decompressing gas in the other of the first space or second space so that a charge of compressed gas exits from the housing to move the impact member, the movable member movable continuously to provide a series of a plurality of movements of the impact member, the system thereby providing a series of a plurality of impacts.

2. The system of claim 1 wherein the system is a system for driving a pile into the earth and the housing is positionable adjacent the pile so that the impact member impacts the pile.

3. The system of claim 1 wherein the system is a system for drilling a borehole into the earth, the system including drill bit apparatus, the housing positionable adjacent the drill bit apparatus so that the impact member impacts the drill bit apparatus.

4. A system for moving a drilling apparatus for drilling a borehole in a formation, said system comprising a housing with a longitudinal axis, a movable member movably disposed within the housing, the movable member movable within the housing transversely to the longitudinal axis of the housing, the movable member positioned within the housing with a first space on a first side thereof and a second space on a second side thereof, the first space substantially fluidly isolated from the second space by the movable member, the movable member movable to compress gas in one of the first space and the second space while decompressing gas in the other of the first space or second space so that a charge of compressed gas exits from the housing to move an impact member for impacting the drill apparatus for drilling the wellbore, the movable member movable continuously to provide a series of a plurality of movements of the impact member.

5. A percussion drill assembly for drilling a borehole in a formation, said percussion drill assembly comprising an elongated housing assembly having a first end adapted to removably connect said drill assembly to a drill string, and a second end adapted to receive a drill bit, a first compartment formed within said housing assembly and having a longitudinal axis, a hammer piston positioned within said first compartment for reciprocal motion within said first compartment along the longitudinal axis of said first compartment, said hammer piston dividing said first compartment into a first chamber and a second chamber which are substantially fluidly isolated from each other within said first compartment by the presence of said hammer piston, a fluid compressor positioned within said housing assembly and having a first port in said first chamber and a second port in said second chamber, wherein a second compartment is formed within said housing assembly, said second compartment having a longitudinal axis; wherein said fluid compressor comprises a compressor piston positioned within said second compartment for reciprocal motion within said second compartment transverse to the longitudinal axis of said second compartment, said compressor piston dividing said second compartment into a third chamber and a fourth chamber which are substantially fluidly isolated from each other within said second compartment by the presence of said compressor piston, wherein said first port provides fluid communication with said third chamber, and said second port provides fluid communication with said fourth chamber, a driver mounted in said housing assembly and connected to said compressor piston so as to drive said compressor piston to produce a high fluid pressure in said first port and a low fluid pressure in said second port during a first half cycle of operation of said fluid compressor and to produce a low fluid pressure in said first port and a high fluid pressure in said second port during a second half cycle of operation of said fluid compressor, and wherein said driver is connected to said compressor piston to cause reciprocating movements of said compressor piston within said second compartment.

6. The percussion drill assembly of claim 5 further comprising seals for sealing said fluid compressor from fluid communication with any fluid received from the drill string, whereby said compressor fluid system is a closed fluid system.

7. The percussion drill assembly of claim 5 wherein when said drill assembly is being operated to impart an impact force to a drill bit, a high fluid pressure in said first chamber and a low fluid pressure in said second chamber causes a movement of said hammer piston toward said second chamber, and wherein when said drill assembly is being operated to impart an impact force to a drill bit, a low fluid pressure in said first chamber and a high fluid pressure in said second chamber causes a movement of said hammer piston toward said first chamber.

8. The percussion drill assembly of claim 5 wherein when said housing assembly comprises a bit adapter at said second end of said housing assembly for receiving a drill bit, said bit adapter having an anvil surface exposed to said compartment, and wherein said drill assembly further comprises a drill bit removably connected to said bit adapter, and whereby a predetermined extent of movement of said hammer piston in one of its directions of movement causes said hammer piston to strike said anvil surface and impart an impact blow to said bit adapter when said drill bit is in contact with a borehole bottom.

9. The percussion drill assembly of claim 8 wherein when said driver comprises a fluid motor which is driven by a drilling fluid passed downwardly through a drill string to the drill assembly, and wherein the drilling fluid is exhausted from said fluid motor through said second end of said housing assembly and through said drill bit.

10. The percussion drill assembly of claim 5 wherein when said driver comprises a fluid motor which is driven by a drilling fluid passed downwardly through a drill string to the drill assembly.

11. The percussion drill assembly of claim 10 wherein when said fluid motor has a liquid inlet and a liquid outlet, said fluid motor has a stator and a rotor positioned between said liquid inlet and said liquid outlet, said driver comprises a rotary shaft and said rotor is connected to said rotary shaft so that rotation of said rotor causes corresponding rotation of said rotary shaft, wherein the rotation of said rotary shaft drives said fluid compressor, and wherein said liquid inlet of said motor is connected to an inlet passageway in said first end of said housing assembly so that liquid from a drill string flows through said inlet passageway and then flows between said stator and said rotor to said liquid outlet to effect rotation of said rotor with respect to said housing assembly, thereby rotating said rotary shaft and driving said fluid compressor.

12. A percussion drill assembly for drilling a borehole in a formation, the percussion drill assembly comprising an elongated housing assembly having a first end adapted to removably connect said drill assembly to a drill string, and a second end adapted to receive a drill bit, a first compartment formed within said housing assembly and having a longitudinal axis, a hammer piston positioned within said first compartment for reciprocal motion within said first compartment along the longitudinal axis of said first compartment, said hammer piston dividing said first compartment into a first chamber and a second chamber which are substantially fluidly isolated from each other within said first compartment by the presence of said hammer piston, a fluid compressor positioned within said housing assembly and having a first port in said first chamber and a second port in said second chamber, wherein a second compartment is formed within said housing assembly, said second compartment having a longitudinal axis; wherein said compressor comprises a compressor piston positioned within said second compartment for reciprocal motion within said second compartment transverse to the longitudinal axis of said second compartment, said compressor piston dividing said second compartment into a third chamber and a fourth chamber which are substantially fluidly isolated from each other within said second compartment by the presence of said compressor piston, wherein said first port provides fluid communication with said third chamber, and said second port provides fluid communication with said fourth chamber, a driver mounted in said housing assembly and connected to said compressor piston so as to drive said compressor piston to produce a high fluid pressure in said first port and a low fluid pressure in said second port during a first half cycle of operation of said first compressor and to produce a low fluid pressure in said first port and a high fluid pressure in said second port during a second half cycle of operation of said first compressor, wherein said driver is connected to said compressor piston to cause reciprocating movements of said compressor piston within said second compartment, seals for sealing said fluid compressor from fluid communication with any fluid received from the drill string, whereby said compressor fluid system is a closed fluid system, wherein said drill assembly is operable to impart an impact force to a drill bit, a high fluid pressure in said first chamber and a low fluid pressure in said second chamber causing a movement of said hammer piston toward said second chamber, wherein said drill assembly is operable to impart an impact force to a drill bit, a low fluid pressure in said first chamber and a high fluid pressure in said second chamber causes a movement of said hammer piston toward said first chamber, wherein said housing assembly comprises a bit adapter at said second end of said housing assembly for receiving a drill bit, said bit adapter having an anvil surface exposed to said compartment, wherein said drill assembly further comprises a drill bit removably connected to said bit adapter, whereby a predetermined extent of movement of said hammer piston in one of its directions of movement causes said hammer piston to strike said anvil surface and impart an impact blow to said bit adapter when said drill bit is in contact with a borehole bottom, wherein said driver comprises a fluid motor which is driven by a drilling fluid passed downwardly through a drill string to the drill assembly, and wherein the drilling fluid is exhausted from said fluid motor through said second end of said housing assembly and through said drill bit, wherein said fluid motor has a liquid inlet and a liquid outlet, a stator and a rotor positioned between said liquid inlet and said liquid outlet, said driver comprises a rotary shaft and said rotor is connected to said rotary shaft so that rotation of said rotor causes corresponding rotation of said rotary shaft, wherein the rotation of said rotary shaft drives said fluid compressor, and wherein said liquid inlet of said motor is connected to an inlet passageway in said first end of said housing assembly so that liquid from the drill string flows through said inlet passageway and then flows between said stator and said rotor to said liquid outlet to effect rotation of said rotor with respect to said housing assembly, thereby rotating said rotary shaft and driving said fluid compressor.

13. A liquid-driven, gas-operated, percussion drill assembly for drilling a borehole in a formation, said drill assembly comprising an elongated housing assembly, said housing assembly having a first end and a second end opposite said first end, and a longitudinal axis extending from said first end to said second end, an end portion of said housing assembly at said first end being adapted for removably connecting said drill assembly to a drill string, said end portion having a first passageway extending therethrough for the passing of a liquid received from the drill string, an elongated first compartment formed within said housing assembly, said first compartment having a longitudinal axis which is at least generally parallel to the longitudinal axis of said housing assembly, a first piston positioned within said first compartment for reciprocal motion within said first compartment transverse to the longitudinal axis of said first compartment, said first piston dividing said first compartment into a first right chamber and a first left chamber which are substantially fluidly isolated from each other within said first compartment by the presence of said first piston, a first shaft having a longitudinal axis, said first shaft being rotatably mounted in said housing assembly with the longitudinal axis of said first shaft being at least generally parallel to the longitudinal axis of said housing assembly, said first shaft being engaged with said first piston such that rotation of said first shaft causes reciprocating movement of said first piston within said first compartment, a motor positioned in said housing assembly and having a liquid inlet and a liquid outlet, said motor having a stator and a rotor positioned between said liquid inlet and said liquid outlet, said rotor being connected to said first shaft so that rotation of said rotor causes corresponding rotation of said first shaft, said liquid inlet of said motor being connected to the first passageway in said end portion of said housing assembly so that liquid from said first passageway flows between said stator and said rotor to said liquid outlet to effect rotation of said rotor with respect to said housing assembly, thereby rotating said first shaft and reciprocating said first piston, an elongated second compartment formed within said housing assembly, said second compartment having a longitudinal axis which is at least generally parallel to the longitudinal axis of said housing assembly, a second piston positioned within said second compartment for reciprocal motion within said second compartment along the longitudinal axis of said second compartment, said second piston dividing said second compartment into a first upper right chamber and a first lower chamber which are substantially fluidly isolated from each other within said second compartment by the presence of said second piston, a bit adapter having an anvil surface at a first end thereof and a drill bit receiving opening at a second end thereof, said bit adapter being removably attached to said second end of said housing assembly with said anvil surface of said bit adapter being exposed to said first lower left chamber, a second passageway providing fluid communication between said first right chamber and a first one of said first upper chamber and said first lower chamber, a third passageway providing fluid communication between said first left chamber and a second one of said first upper chamber and said first lower chamber, seals for sealing said first and second compartments and said second and third passageways from fluid communication with said first passageway, whereby said first and second compartments and said second and third passageways constitute a closed fluid system, each of said first right chamber, said first upper chamber, said first left chamber, said first lower chamber and said second and third passageways having gas therein, wherein movement of said first piston toward said first right chamber compresses the gas in said first right chamber and thus increases the pressure of the gas in said first right chamber, in said second passageway, and in said first one of said first upper chamber and said first lower chamber, thereby causing the movement of said second piston toward said second one of said first upper chamber and said first lower chamber, and wherein movement of said first piston toward said first left chamber compresses the gas in said first left chamber and thus increases the pressure of the gas in said first left chamber, in said third passageway, and in said second one of said first upper chamber and said first lower chamber, thereby causing the movement of said second piston toward said first upper chamber and said first lower chamber.

14. The liquid-driven, gas-operated, percussion drill assembly of claim 13 further comprising a drill bit removably connected to said bit adapter.

15. The liquid-driven, gas-operated, percussion drill assembly of claim 13 further comprising an eccentric element on said first shaft for acting on said first piston such that rotation of said first shaft in a single direction causes reciprocating movements of said first piston within said first compartment perpendicular to the longitudinal axis of said first compartment.

16. The liquid-driven, gas-operated, percussion drill assembly of claim 13 wherein said motor has a bypass passageway therein in communication with said first passageway for passing a portion of the liquid received from said drill string to said liquid outlet of said motor without said portion of the liquid going between said stator and said rotor.

17. The liquid-driven, gas-operated, percussion drill assembly of claim 13 wherein said rotor has a central longitudinal axis, said bypass passageway extends internally through said rotor, and said bypass passageway is not centrally located in said rotor.

18. The liquid-driven gas-operated, percussion drill assembly of claim 13 wherein said second end of said housing assembly comprises an annular chuck positioned outwardly of and coaxially with an intermediate portion of said bit adapter, whereby said bit adapter can slide axially with respect to said chuck so that said bit adapter can move downwardly with respect to said chuck when the drill bit is not in contact with a borehole bottom.

19. A method of operating a percussion drill assembly for drilling a borehole in a formation, said method comprising charging a closed fluid system of a percussion drill assembly with a fluid under pressure, said percussion drill assembly comprising an elongated housing assembly having a first end adapted to removably connect said drill assembly to a drill string, and a second end adapted to receive a drill bit, a first compartment formed within said housing assembly and having a longitudinal axis, a hammer piston positioned within said first compartment for reciprocal motion within said first compartment along the longitudinal axis of said first compartment, said hammer piston dividing said first compartment into a first chamber and a second chamber which are substantially fluidly isolated from each other within said first compartment by the presence of said hammer piston, a fluid compressor positioned within said housing assembly and having a first port in said first chamber and a second port in said second chamber, wherein a second compartment is formed within said housing assembly, said second compartment having a longitudinal axis; wherein said compressor comprises a compressor piston positioned within said second compartment for reciprocal motion within said second compartment perpendicular to the longitudinal axis of said second compartment, said compressor piston dividing said second compartment into a third chamber and a fourth chamber which are substantially fluidly isolated from each other within said second compartment by the presence of said compressor piston, wherein said first port provides fluid communication with said third chamber, and said second port provides fluid communication with said fourth chamber, a driver mounted in said housing assembly and connected to said compressor piston so as to drive said compressor piston to produce a high fluid pressure in said first port and a low fluid pressure in said second port during a first half cycle of operation of said first compressor and to produce a low fluid pressure in said first port and a high fluid pressure in said second port during a second half cycle of operation of said first compressor, and wherein said driver is connected to said compressor piston to cause reciprocating movements of said compressor piston within said second compartment, connecting said first end of said drill assembly to a drill string, connecting said second end of said drill assembly to a drill bit, operating said drill assembly to impart an impact force to said drill bit by actuating said motor to rotate said shaft and thereby reciprocate said compressor piston, thereby causing the movement of said hammer piston whereby movement of said hammer piston imparts an impact force to said drill bit.

20. The method of claim 19 further comprising rotating the drill string to thereby rotate said drill bit.

21. The method of claim 19 further comprising passing drilling fluid through the drill string into and through said motor to actuate said motor and passing drilling fluid from said motor to and through said drill bit to flush drilling debris from the drill bit.

22. The method of claim 19 wherein the fluid which is charged to said closed fluid system is a gas.

23. A method for providing cyclical impacts, the method comprising impacting an item with an impact member of a system, the system for providing cyclical impacts, the system comprising a housing with a longitudinal axis, the impact member adjacent the housing, a movable member movably disposed within the housing, the movable member movable within the housing transversely to the longitudinal axis of the housing, the movable member positioned within the housing with a first space on a first side thereof and a second space on a second side thereof, gas in the first space and gas in the second space, the first space substantially fluidly isolated from the second space by the movable member, the movable member movable to compress gas in one of the first space and the second space while decompressing gas in the other of the first space or second space so that a charge of compressed gas exits from the housing to move the impact member, the movable member movable continuously to provide a series of a plurality of movements of the impact member, the system thereby providing a cyclical series of a plurality of impacts.

24. A method of drilling a wellbore in an earth formation with a drilling apparatus, the method comprising impacting a drilling apparatus with an impact member of a system, the system for moving the impact member, the system comprising a housing with a longitudinal axis, a movable member movably disposed within the housing, the movable member movable within the housing transversely to the longitudinal axis of the housing, the movable member positioned within the housing with a first space on a first side thereof and a second space on a second side thereof, the first space substantially fluidly isolated from the second space by the movable member, the movable member movable to compress gas in one of the first space and the second space while decompressing gas in the other of the first space or second space so that a charge of compressed gas which exits from the housing to move an impact member for impacting the drill apparatus for drilling the wellbore, the movable member movable continuously to provide a series of a plurality of movements of the impact member to provide a plurality of impacts to the drilling apparatus.

* * * * *

UNITED STATES PATENT AND TRADEMARK OFFICE

CERTIFICATE OF CORRECTION

PATENT NO. : 7,040,417 B2
APPLICATION NO. : 10/733171
DATED : May 9, 2006
INVENTOR(S) : Paul B. Campbell and James E. Coffman It is certified that error appears in the above-identified patent and that said Letters Patent is hereby corrected as shown below:

Column 11, line 41, change “152” to --231--;
Column 23, line 52, remove “right”;
Column 23, line 61, remove “left”

Signed and Sealed this

Second Day of October, 2007

JON W. DUDAS
*Director of the United States Patent and Trademark Office*